US009949605B2

(12) United States Patent
Isley et al.

(10) Patent No.: US 9,949,605 B2
(45) Date of Patent: Apr. 24, 2018

(54) CLEANER HEAD

(71) Applicant: Dyson Technology Limited, Wiltshire (GB)

(72) Inventors: David Andrew Isley, Gloucester (GB); Gerard Matthew Shevlin, Gloucester (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 46 days.

(21) Appl. No.: 15/127,347

(22) PCT Filed: Mar. 16, 2015

(86) PCT No.: PCT/GB2015/050763
§ 371 (c)(1),
(2) Date: Sep. 19, 2016

(87) PCT Pub. No.: WO2015/140525
PCT Pub. Date: Sep. 24, 2015

(65) Prior Publication Data

US 2017/0127895 A1 May 11, 2017

(30) Foreign Application Priority Data

Mar. 19, 2014 (GB) ..... 1404917.5

(51) Int. Cl.
*A47L 9/04* (2006.01)

(52) U.S. Cl.
CPC ..... *A47L 9/0477* (2013.01); *A47L 9/0411* (2013.01)

(58) Field of Classification Search
CPC ..... A47L 9/0411; A47L 9/0477
See application file for complete search history.

(56) References Cited

U.S. PATENT DOCUMENTS 6,892,420 B1 * 5/2005 Haan ..... A46B 13/001 15/339
2004/0010875 A1 * 1/2004 Roney ..... A47L 9/0477 15/141.2
2009/0000057 A1 * 1/2009 Yoo ..... A47L 9/04 15/415.1
2009/0229075 A1 * 9/2009 Eriksson ..... A46B 13/006 15/383

(Continued)

FOREIGN PATENT DOCUMENTS

WO WO-2013/060365 5/2013
WO WO 2013060365 A1 * 5/2013 ..... A47L 9/02

OTHER PUBLICATIONS

Search Report and Written Opinion dated Jun. 3, 2015, directed to International Application No. PCT/GB2015/050763, 8 pages.

*Primary Examiner* — Marc Carlson
(74) *Attorney, Agent, or Firm* — Morrison & Foerster LLP

(57) ABSTRACT

A cleaner head for a cleaning appliance, the cleaner head including a main body having an air inlet and an air outlet, an agitator supported for rotation with respect to the main body about a rotational axis, and a collector for collecting strands of hair. The collector is supported by the main body and arranged such that strands of hair drawn through the air inlet wrap around at least part of the collector. The collector is movable with respect to the main body between a hair collecting position in which the agitator is rotatable with respect to the collector and a hair removal position.

19 Claims, 4 Drawing Sheets

(56) References Cited

U.S. PATENT DOCUMENTS

| | | | | |
|---|---|---|---|---|
| 2013/0007982 | A1* | 1/2013 | Yun | A47L 9/0477 15/347 |
| 2013/0056026 | A1* | 3/2013 | Jung | A47L 9/0411 134/6 |
| 2014/0259522 | A1* | 9/2014 | Kasper | A47L 9/0477 15/383 |
| 2014/0304941 | A1* | 10/2014 | Eriksson | A47L 9/02 15/383 |
| 2014/0331446 | A1* | 11/2014 | Eriksson | A46B 13/006 15/383 |
| 2015/0265117 | A1* | 9/2015 | Genn | A47L 9/0411 15/363 |
| 2017/0296012 | A1* | 10/2017 | Moyher, Jr. | A47L 9/0613 |

* cited by examiner

CLEANER HEAD

REFERENCE TO RELATED APPLICATIONS

This application is a national stage application under 35 USC 371 of International Application No. PCT/GB2015/050763, filed Mar. 16, 2015, which claims priority to United Kingdom Application No. 1404917.5, filed Mar. 19, 2014, the entire contents of which are incorporated herein by reference.

FIELD OF THE INVENTION

This invention relates to a cleaner head for a cleaning appliance and particularly, although not exclusively, relates to a cleaner head for a vacuum cleaner, such as a vacuum cleaner for domestic use.

BACKGROUND OF THE INVENTION

Cleaner heads for vacuum cleaning appliances often comprise a rotatable brushbar for improving debris pickup from carpets.

Types of debris picked up during cleaning include dust, dirt, food particles and hair. Long strands of hair can be problematic because they often wrap around the brushbar instead of being drawn into the cleaning appliance. In addition, the slender nature of hair means that hair strands can work their way between the ends of the brushbar and the cleaner head housing and wrap themselves around a driveshaft for the brushbar or else get tangled with components, for example bearings or a brushbar motor, housed by the brushbar. Typically, a brushbar can be removed from a cleaner head so that hair which has become trapped on or inside the brushbar can be removed. However, removal of the hair can be difficult.

SUMMARY OF THE INVENTION

According to a first aspect of the present invention there is provided a cleaner head for a cleaning appliance, comprising a main body having an air inlet and an air outlet, an agitator supported for rotation with respect to the main body about a rotational axis, and a collector for collecting strands of hair, the collector is supported by the main body and arranged such that strands of hair drawn through the air inlet wrap around at least part of the collector, the collector is movable with respect to the main body between a collecting position in which the agitator is rotatable with respect to the collector and a removal position.

A cleaner head having a collector which is movable between a collecting position in which hair is collected by, and accumulates on, the collector and a removal position in which hair collected by the collector can be removed readily is easy to maintain by a user who can periodically remove hair that has accumulated on the collector without undue difficulty.

The collector may be movable between the collecting position and the removal position in a direction which is substantially parallel with the rotational axis of the agitator.

The collector may be rotatably fixed with respect to the main body when in the collecting position. For example, the collector may be provided with a first engagement feature that is arranged to engage with a second engagement feature provided on the main body such that rotation of the collector with respect to the main body is prevented when the collector is in the collecting position.

The first engagement feature may be a slot that extends substantially in the direction of the rotational axis. The second engagement feature may be a rib that extends in substantially the same direction as the slot.

At least part of the slot may be exposed in the removal position so that a cutting implement can be inserted into the slot to cut strands of hair collected by the collector.

The agitator may have a braking surface which is arranged such that hair which has accumulated on the collector engages the braking surface, thereby resisting rotation of the agitator. The collector may be at least partially housed by the agitator. The braking surface may be an internal surface of the agitator.

The agitator may be a brushbar. The brushbar may be elongate and have a rotational axis which extends in the longitudinal direction of the brushbar. For example the brushbar may comprise a tubular portion which may be provided with bristles that extend radially outwardly from the brushbar.

The main body may comprise an axle on which the brushbar is supported for rotation. The axle may further support the collector and/or a motor for driving the brushbar.

The cleaner head may further comprise a bearing arranged to support the brushbar for rotation. The bearing may be at least partially housed by the brushbar. The collector may be arranged to prevent hair entering the bearing. For example, the collector may be disposed between the bearing and an end of the brushbar.

The cleaner head may comprise a biasing device, for example a resilient member such as a spring, which is arranged to bias the collector towards the collecting position. The biasing device may bias the collector against the main body.

The collector may comprise a spool on which the strands of hair are collected. The spool may be arranged coaxially with the rotational axis of the agitator.

The spool may be provided with a retaining protrusion that is arranged to retain hair on the spool. The retaining protrusion may be a lip or ridge. The protrusion may be one of a plurality of protrusions, for example a plurality of protrusions spaced circumferentially about the spool.

The spool may be arranged with respect to the main body such that a collecting region of the spool is disposed between the retaining protrusion and the main body.

The collector may be arranged such that it abuts the main body in the collecting position and is spaced away from the main body in the removal position.

According to a second aspect of the invention there is provided a cleaning appliance comprising a cleaner head in accordance with the first aspect of the invention.

BRIEF DESCRIPTION OF THE DRAWINGS

In order to better understand the present invention, and to show more clearly how the invention may be put into effect, the invention will now be described, by way of example, with reference to the following drawings.

DETAILED DESCRIPTION OF THE INVENTION

Figure 1:
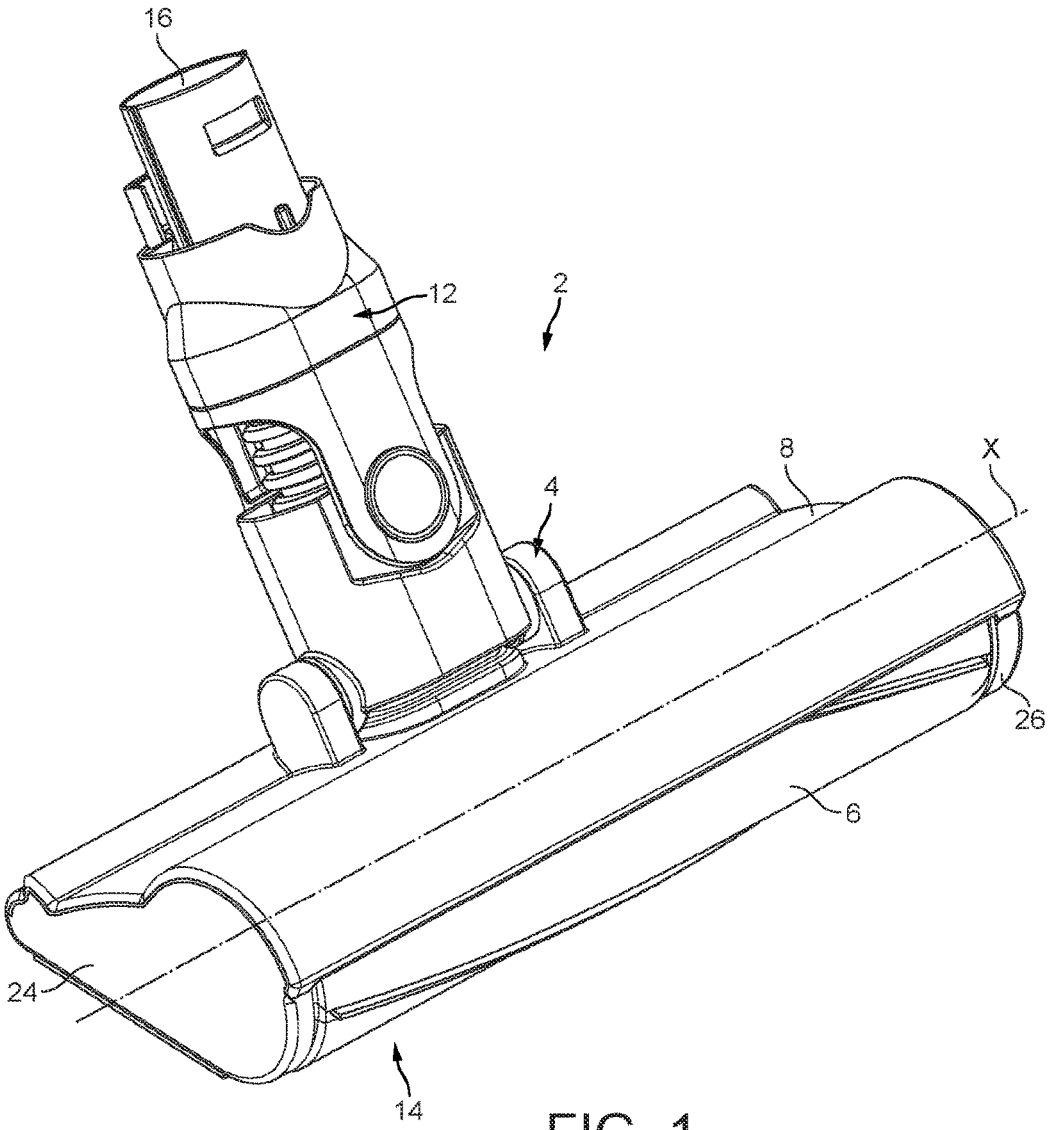
FIG. 1 is a perspective view of a cleaner head for a cleaning appliance.

FIGS. 1 to 4 show a cleaner head 2 comprising a main body 4 and an agitator in the form of a brushbar 6 supported for rotation by the main body 4. The brushbar 6 has a rotational axis X. The main body 4 comprises a housing 8 having a chamber 10 (shown in FIG. 3), within which the brushbar 6 is disposed, and an articulated neck 12 which is pivotally connected to the housing 8.

The housing 8 has an inlet opening 14 which extends across the underside and the front of the housing 8. The brushbar 6 is exposed through the opening 14. The inlet opening 14 provides an inlet to the cleaner head 2 through which air is drawn during use.

The articulated neck 12 comprises an outlet opening 16 at the end not connected to the housing 8. The outlet opening 16 provides an outlet from the cleaner head 2. The articulated neck 12 is connectable to a separator of a vacuum cleaner (not shown) either directly or via a wand or hose, for example.

Figure 2:
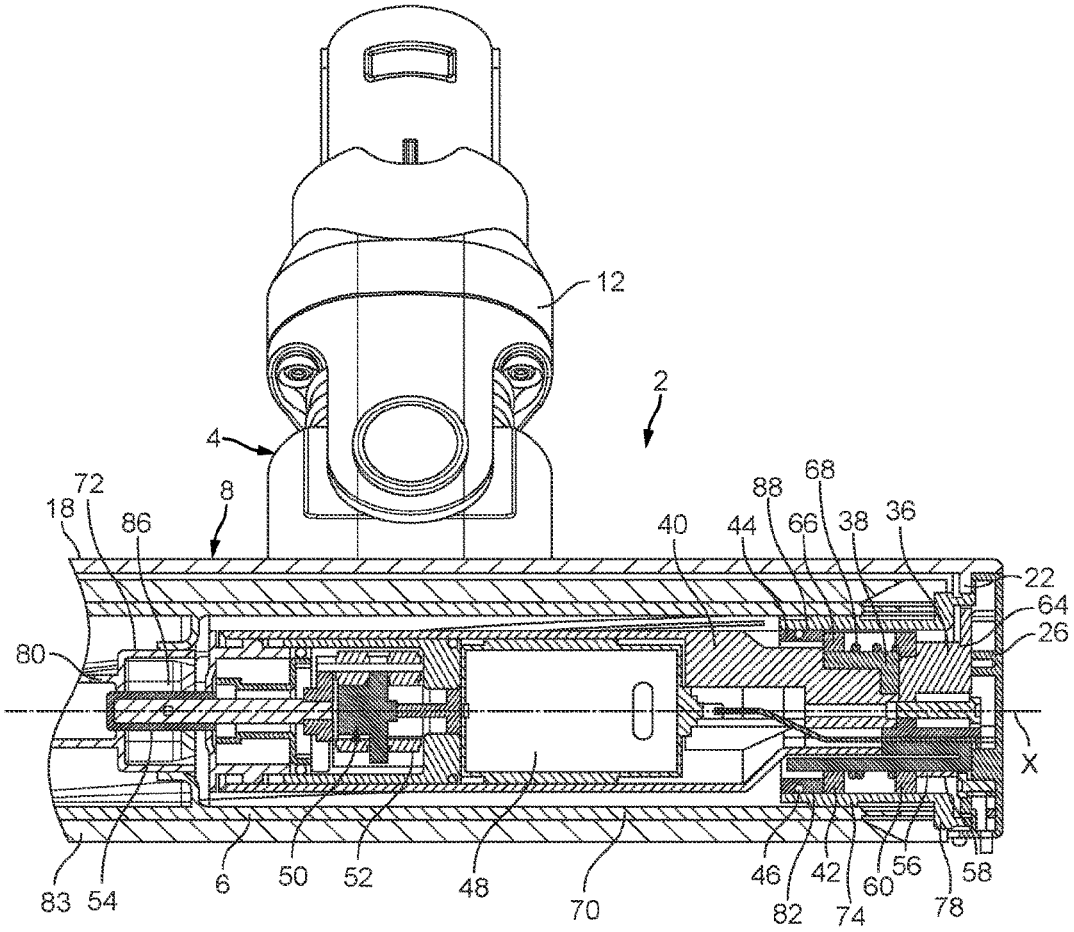
FIG. 2 is a sectional view of the cleaner head shown in FIG. 1.

FIG. 2 is a sectional view of the cleaner head 2 along the rotational axis X of the brushbar 6.

The housing 8 comprises a top portion 18 and first and second side portions 20, 22 which define the chamber 10 within which the brushbar 6 is located. Each side portion 20, 22 is provided, respectively, with first and second end caps 24, 26. The first end cap 24 is removable from the first side portion 20.

The second side portion 22 is covered by the second end cap 26. The second side portion 22 comprises a mounting portion 36, part of which projects into the chamber 10. A drive housing mount 38 is secured to the mounting portion 36. The drive housing mount 38 is substantially cylindrical. The drive housing mount 38 supports an elongate drive housing 40 which extends from the drive housing mount 38 further into the chamber 10 along the rotational axis X. A bearing 42, such as a roller bearing, is supported by the drive housing mount 38. The bearing 42 extends circumferentially about an outer surface of the drive housing mount 38. The bearing 42 supports a second brushbar mount 44 for rotation with respect to the drive housing mount 38. The second brushbar mount 44 is provided with a seal 46, in the form of an o-ring, on an outer surface of the second brushbar mount 44.

The drive housing 40 houses a brushbar motor (only the casing 48 for which is shown) and a transmission 50. The transmission 50 comprises a gear arrangement 52 and a drive dog 54. The drive dog 54 protrudes from the end of the drive housing 40 opposite the drive housing mount 38.

A collector in the form of a spool 56 is mounted on the mounting portion 36 between the bearing 42 and the second side portion 22 of the housing 8. The spool 56 is cylindrical and comprises an outer surface 58 for collecting strands of hair and a circumferential rib 60 at one end for preventing strands of hair that have collected on the outer surface 58 from sliding off the spool 56. In particular, the rib 60 helps prevent hair from getting tangled with the bearing 42 or the brushbar motor.

The spool 56 is slidably mounted on the mounting portion 36 so that it can slide from a hair collecting position in which the spool 56 abuts the second side portion 22 and a hair removal position in which the spool 56 is spaced from the second side portion 22.

The spool 56 is provided with slots 62 (see FIG. 3) that engage with ribs 64 provided on the mounting portion 36. The ribs 64 prevent rotation of the spool 56 when the spool 56 is in the collecting position.

An abutment feature in the form of a circumferential rib 66 is provided on the drive housing mount 38. A biasing device in the form of a compression spring 68 is disposed between the rib 66 and the spool 56. One end of the spring 68 abuts the rib 66 and the other end of the spring 68 abuts the spool 56. The spring 68 biases the spool 56 into the collecting position and holds the spool 56 firmly against the second side portion 22 of the housing 8. The rib 66 provides a second function of holding the bearing 42 in position on the drive housing mount 38.

The brushbar 6 comprises a hollow cylindrical body 70 and first and second end plugs 72, 74 disposed respectively at each of the ends of the cylindrical body 70. Each end plug 72, 74 has a flange 78, which abuts a respective end of the cylindrical body 70, and a substantially cylindrical portion 80, 82 which protrudes from the flange 78 into the cylindrical body 70. Bristles 83, which are arranged in circumferentially spaced strips, extend radially outwardly from the cylindrical body 70.

The second plug 74 is open at both ends so that the mounting portion 36, drive housing mount 38, drive housing 40, bearing 42 and second brushbar mount 44 assembly, which forms an axle on which the brushbar 6 is supported, can pass through the open ends into the cylindrical body 70. The second plug 74 is secured for rotation with the cylindrical body 70. The second plug 74 has an internal sealing surface 88 against which the seal 46, which is provided on the second brushbar mount 44, seals.

During use, air is drawn in through the inlet opening 14, past the brushbar 6 and out through the outlet opening 16 to the separator of the vacuum cleaner to which the cleaner head 2 is connected. The brushbar motor, which in the embodiment shown is powered by a power source external to the cleaner head 2, drives the brushbar 6 in rotation via the transmission 50. In particular, the brushbar motor drives the gear arrangement 52, which drives the drive dog 54. The drive dog 54, which is received by the socket 86, drives the first plug 72 and hence the brushbar 6 to rotate within the chamber 10.

The rotating brushbar 6 agitates debris located on a surface being cleaned, for example debris located between carpet fibers. During cleaning, strands of hair (or other long fibers, such as cotton threads, ribbon etc.) may be picked up by the brushbar 6. Although most strands of hair will be drawn out through the outlet opening 16 to the separator, some will wrap around the brushbar and become trapped. Furthermore, it is expected that strands of hair will work their way over the ends of the brushbar 6 through the gaps between the flanges 78 and the first and second side portions 20, 22 of the housing 8. Hair strands which find their way between the gap between the flange 78 of the second plug 74 are wrapped about the outer surface 58 of the spool 56 by rotation of the brushbar 6.

The strands of hair collect as a bale around the outer surface 58 of the spool 56. The rib 60 together with the second side portion 22 prevent the hair from slipping from the spool 56. As hair accumulates, the thickness of the bail increases until it presses against a region of the inner surface of the second plug 74 which is adjacent the flange 78. The spool 56 is held rotationally fixed with respect to the mounting portion 36 by engagement of the slots 62 provided in the spool 56 with the ribs 64 on the mounting portion 36. Consequently, the region of the inner surface of the second plug 74 against which the hair presses forms a braking surface which exerts a braking torque on the brushbar 6. The braking torque exerted on the brushbar 6 increases as the quantity of hair collected by the spool 56 increases. Once the braking torque exceeds the drive torque transferred to the brushbar 6 by the brushbar motor, the brushbar 6 stalls (i.e. stops rotating). The hair then needs to be removed from the spool 56.

The first end cap 24 is removed from the end of the housing 8 together with the brushbar 6 along the rotational axis X, thereby exposing the mounting portion 36, drive housing mount 38, drive housing 40, bearing 42 and second brushbar mount 44.

Figure 3:
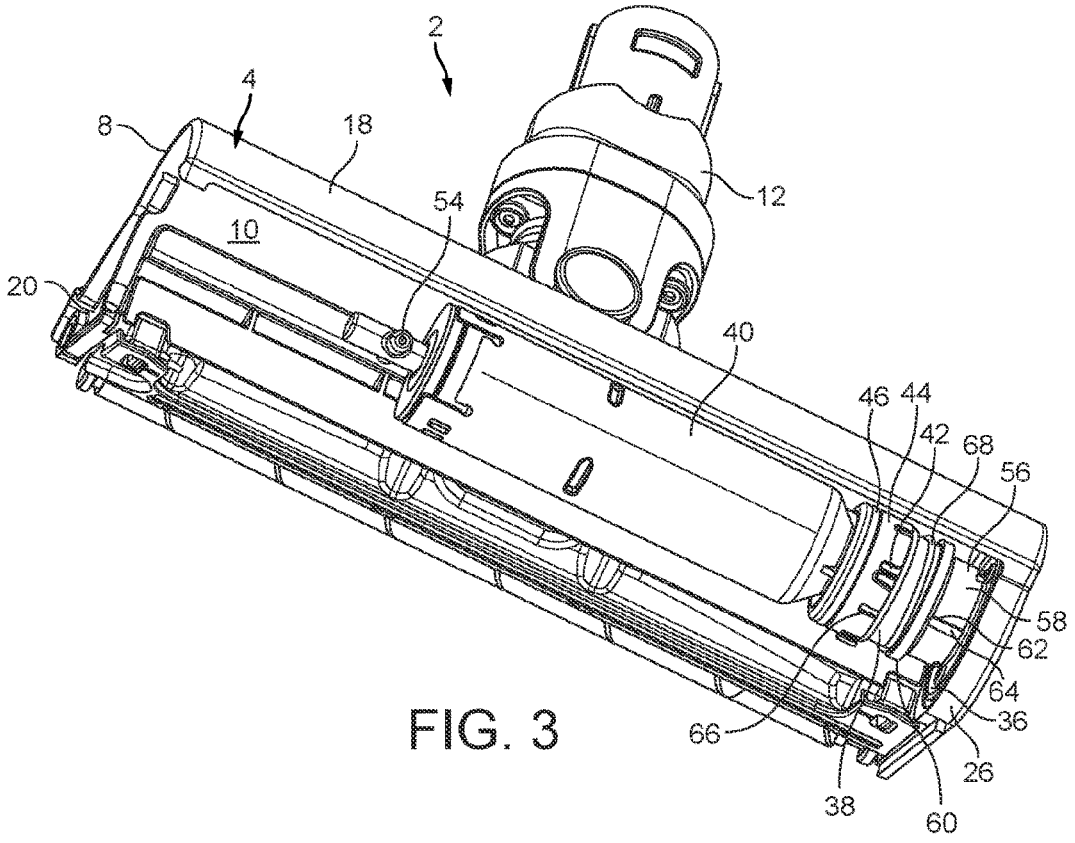
FIG. 3 is a perspective view of part of the cleaner head shown in FIG. 1 in a first configuration.

FIG. 3 shows the cleaner head 2 in a first configuration in which the brushbar 6 has been removed and the spool 56 is in the collecting position.

Figure 4:
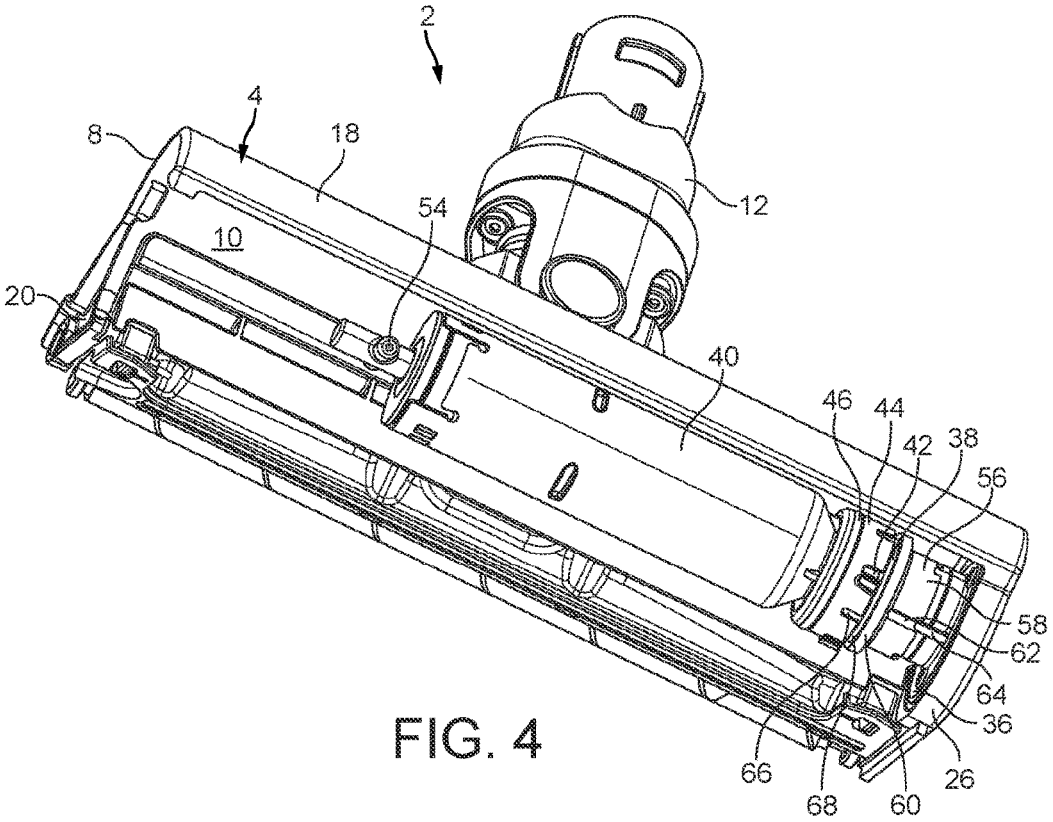
FIG. 4 is a perspective view of part of the cleaner head shown in FIG. 1 in a second configuration.

FIG. 4 corresponds to FIG. 3, but shows the cleaner head 2 in a second configuration in which the spool 56 is in the removal position (i.e. the position in which hair can be removed from the spool 56 as described above). The spool 56 is pushed into the removal position shown in FIG. 4 by sliding the spool 56 along the mounting portion 36. The stiffness of the spring 68 is such that the spool 56 can be manually moved into the removal position by a user, for example by using fingers. In the removal position, the spring 68 is compressed by the spool 56 against the circumferential rib 66 on the drive housing mount 38.

With the spool 56 in the removal position it is readily accessible to a user. In addition, a cutting element such as a pair of scissors or a knife, can be inserted into one of the slots 62 to cut the hair strands from the spool 56. This allows the hair to be cut-away from the spool 56 readily. Alternatively, the bale of hair could be slid from the outer surface 58 of the spool 56 by sliding the bale of hair from spool 56 onto the ribs 64. The hair could then be cut by inserting a cutting implement between the ribs 64. It will be appreciated that the cleaner head 2 could be modified to increase the range of movement of the spool 56 in order to increase the space between the spool 56 and the second side portion 22 in the removal position so that hair that has been slid onto the ribs 64 can be cut-away easily.

Once the hair has been removed, the spool 56 is released. The spring 68 urges the spool 56 back into the collecting position. The cleaner head 2 can then be reassembled by inserting the brushbar 6 into the chamber 10 over the drive housing 40, and the first end cap 24 replaced.

The invention claimed is:

1. A cleaner head for a cleaning appliance, comprising:
a main body having an air inlet and an air outlet;
an agitator supported for rotation with respect to the main body about a rotational axis; and
a collector for collecting strands of hair, the collector is supported by the main body and arranged such that strands of hair drawn through the air inlet wrap around at least part of the collector, the collector is movable with respect to the main body between a collecting position in which the agitator is rotatable with respect to the collector and a removal position.

2. The cleaner head of claim 1, wherein the collector is movable between the collecting position and the removal position in a direction which is substantially parallel with the rotational axis of the agitator.

3. The cleaner head of claim 1, wherein the collector is provided with a first engagement feature that is arranged to engage with a second engagement feature provided on the main body such that rotation of the collector with respect to the main body is prevented when the collector is in the collecting position.

4. The cleaner head of claim 3, wherein the first engagement feature is a slot that extends substantially in the direction of the rotational axis.

5. The cleaner head of claim 4, wherein the second engagement feature is a rib that extends in substantially the same direction as the slot.

6. The cleaner head of claim 4, wherein at least part of the slot is exposed in the removal position so that a cutting implement can be inserted into the slot to cut strands of hair collected by the collector.

7. The cleaner head of claim 1, wherein the agitator has a braking surface which is arranged such that hair which has accumulated on the collector engages the braking surface, thereby resisting rotation of the agitator.

8. The cleaner head of claim 7, wherein the collector is at least partially housed by the agitator and the braking surface is an internal surface of the agitator.

9. The cleaner head of claim 1, wherein the agitator is a brushbar.

10. The cleaner head of claim 9, wherein the main body comprises an axle on which the brushbar is supported for rotation, wherein the axle further supports the collector and/or a motor for driving the brushbar.

11. The cleaner head of claim 9, further comprising a bearing arranged to support the brushbar for rotation, wherein the bearing is at least partially housed by the brushbar, and the collector is arranged to prevent hair entering the bearing.

12. The cleaner head of claim 1, wherein the cleaner head further comprises a biasing device which is arranged to bias the collector towards the collecting position.

13. The collector head of claim 12, wherein the biasing device biases the collector against the main body.

14. The cleaner head of claim 1, wherein the collector comprises a spool on which the strands of hair are collected.

15. The cleaner head of claim 14, wherein the spool is arranged coaxially with the rotational axis of the agitator.

16. The cleaner head of claim 14, wherein the spool is provided with a retaining protrusion that is arranged to retain hair on the spool.

17. The cleaner head of claim 16, wherein the spool is arranged with respect to the main body such that a collecting region is defined between the retaining protrusion and the main body.

18. The cleaner head of claim 1, wherein the collector is arranged such that it abuts the main body in the collecting position and is spaced away from the main body in the removal position.

19. A cleaning appliance comprising:
a cleaner head comprising:
a main body having an air inlet and an air outlet;
an agitator supported for rotation with respect to the main body about a rotational axis; and
a collector for collecting strands of hair, the collector is supported by the main body and arranged such that strands of hair drawn through the air inlet wrap around at least part of the collector, the collector is movable with respect to the main body between a collecting position in which the agitator is rotatable with respect to the collector and a removal position.

* * * * *